United States Patent [19]

Fritsch et al.

[11] 4,112,649

[45] Sep. 12, 1978

[54] BOOM SECTION FOR TELESCOPIC CRANE BOOM

[75] Inventors: Robert A. Fritsch; Narahari Gattu; Lembit Vaerk, all of Cedar Rapids, Iowa

[73] Assignee: Harnischfeger Corporation, W. Milwaukee, Wis.

[21] Appl. No.: 827,871

[22] Filed: Aug. 26, 1977

[51] Int. Cl.[2] ..... E04C 3/04; E04H 12/34

[52] U.S. Cl. ..... 52/731; 52/118

[58] Field of Search ..... 52/731, 116, 118, 121, 52/115, 117, 632; D12/57, 60; 212/55, 144; 214/141; 182/2; 74/25; 173/43, 28

[56] References Cited

U.S. PATENT DOCUMENTS

| | | | |
|---|---|---|---|
| 1,345,304 | 6/1920 | Zied | 212/55 |
| 2,125,691 | 8/1938 | Ragsdale et al. | 52/731 |
| 3,708,937 | 1/1973 | Sterner | 52/731 X |
| 3,719,403 | 3/1973 | Sung | 308/3 |
| 3,736,710 | 6/1973 | Sterner | 52/114 |
| 4,003,168 | 1/1977 | Brady | D12/57 |
| 4,045,936 | 9/1977 | Sterner | 308/3 R |

FOREIGN PATENT DOCUMENTS

| | | | |
|---|---|---|---|
| 715,869 | 12/1931 | France | 52/731 |
| 2,205,093 | 8/1973 | Fed. Rep. of Germany | 212/55 |
| 2,411,536 | 10/1974 | Fed. Rep. of Germany | 212/55 |
| 2,303,644 | 11/1974 | Fed. Rep. of Germany | 212/144 |
| 31,498 | 11/1964 | German Democratic Rep. | 52/731 |

*Primary Examiner*—Leslie Braun

*Attorney, Agent, or Firm*—James E. Nilles

[57] ABSTRACT

A large light-weight deflection-resistant telescopic boom section of hollow rectangular cross-section comprises spaced apart top and bottom plates and spaced apart vertical side plates welded therebetween inwardly of the side edges thereof. Longitudinal corner stiffeners of angular cross-section are welded between the outwardly extending portion of the top and bottom plates and the associated vertical side plate to shorten the effective height of the side plate, to stiffen the top and bottom plates, to increase the mechanical section properties, and to provide a flat built-in slide pad bearing surface. Vertical side stiffeners of U-shaped cross-section are welded to the vertical side plates at intervals therealong and to the longitudinal corner stiffeners to provide the buckling resistance and increased shear load capacity of side plates.

10 Claims, 8 Drawing Figures

BOOM SECTION FOR TELESCOPIC CRANE BOOM

BACKGROUND OF THE INVENTION

1. Field of Use

This invention relates generally to telescopic booms such as are used on mobile cranes or the like. In particular, it relates to the construction of telescopic boom sections for such telescopic booms.

2. Description of the Prior Art

Current practices in the construction industry and building trades require mobile cranes having telescopic booms which can handle increasingly heavier loads and raise them to greater heights. Attempts to increase boom size, load-handling capability, and strength merely by enlarging the size of prior art designs have not been entirely successful. As the physical size of such telescopic booms and the boom sections used therein are increased, and as the lengths to which they can be extended are increased, the booms become extremely heavy and awkward to operate. Further, the excessive deflections due to higher forces hinder precise load handling and cause undesirable whiplash. Various approaches in boom design and construction have been employed to achieve greater size and strength without suffering undue weight penalties. The prior art contains numerous examples of prior art telescopic booms.

SUMMARY OF THE PRESENT INVENTION

In accordance with the present invention, a telescopic boom for a mobile crane comprises a plurality of large light-weight deflection-resistant telescopic boom sections. Each boom section is of hollow rectangular cross-section and comprises spaced apart top and bottom plates between which a pair of spaced apart vertical side plates are welded. Each side plate is located inwardly of the associated edges of the top and bottom plates so that portions of the top and bottom plates extend outwardly therebeyond. Four longitudinal corner stiffeners of angular cross-section are provided for each boom section, one at each corner thereof, to locally stiffen the side, top and bottom plates to resist slide pad reactions tending to locally deform these plates, and to shorten the effective height of the side plates. Each longitudinal corner stiffener comprises a flat side portion and an inwardly bent portion, such flat side portion being spaced from and parallel to an associated side plate and serving as a slide pad bearing surface. Each longitudinal corner stiffener extends between and is welded to a side plate and an outwardly extending edge portion of either the top plate or bottom plate. A plurality of vertical side stiffeners of generally U-shaped or trapezoidal-shaped cross-section are disposed in longitudinally spaced apart arrangement along each side of the boom section to provide the buckling resistance and increased shear load capacity of the side plates and each is welded to a side plate and to the inwardly bent portion of the top and bottom longitudinal corner stiffeners.

A telescopic boom having boom sections constructed in accordance with the present invention offers numerous advantages. For example, there is an optimum strength-to-weight ratio and an optimum balance between physical size, load-handling characteristics, deflection characteristics, and economy in use of material and fabrication techniques. Unusual and non-standard cross-sectional configurations of the boom sections (which often further complicate the design and construction of the mobile crane upper section) are avoided. A minimum number of components of relatively basic shape, such as simple flat plates, are employed and bracing components of unduly complex shape are avoided thereby simplifying cutting, shaping and welding. Plates of minimum thickness are employed, taking into account other essential design considerations. Also, additional components such as internal braces and separate slide pad bearing surfaces are eliminated. Other objects and advantages of the invention will hereinafter appear.

DESCRIPTION OF A PREFERRED EMBODIMENT

Figure 1:
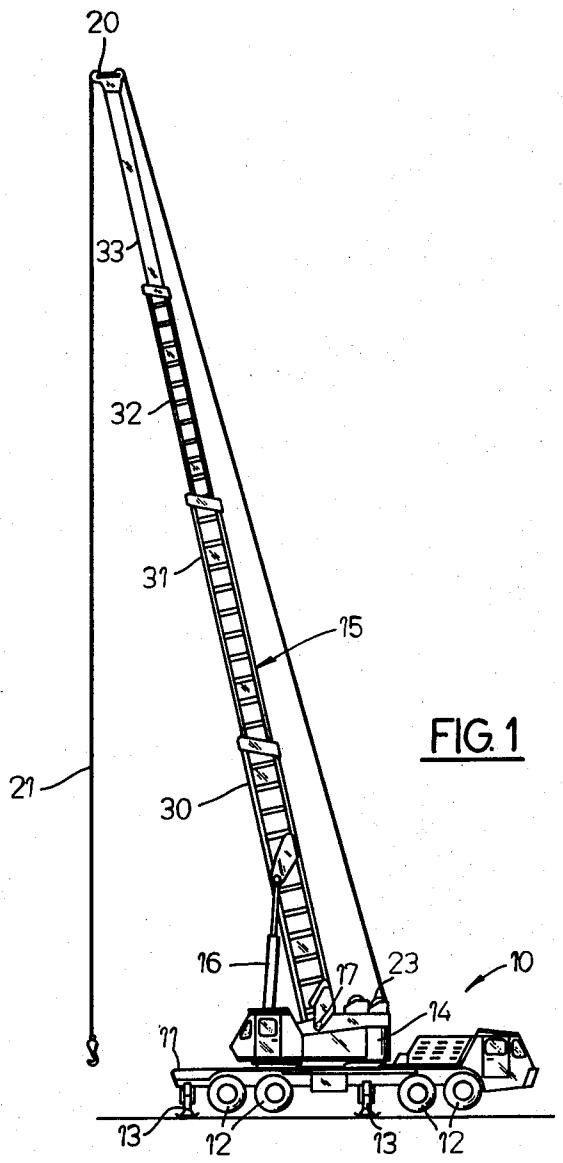
FIG. 1 is a side elevational view of a mobile crane having a telescopic boom employing boom sections in accordance with the present invention and showing the telescopic boom raised and fully extended.

Referring to FIG. 1 of the drawings, the numeral 10 designates a mobile crane in accordance with the invention. Crane 10 comprises a carrier frame 11 having ground-engaging wheels 12, extendable and retractable outriggers 13 (shown fully deployed and supporting the crane), and a rotatable crane upper 14 mounted thereon. Crane upper 14 comprises a telescopic boom 15 which is understood to be pivotable in a vertical plane by means of a boom hoist cylinder 16 about a pivot point 17. Boom 15 has a load hoist line sheave assembly 20 at its point end for supporting a load hoist line 21 which is connected to a hoist drum 23 on crane upper 14.

Figure 2:
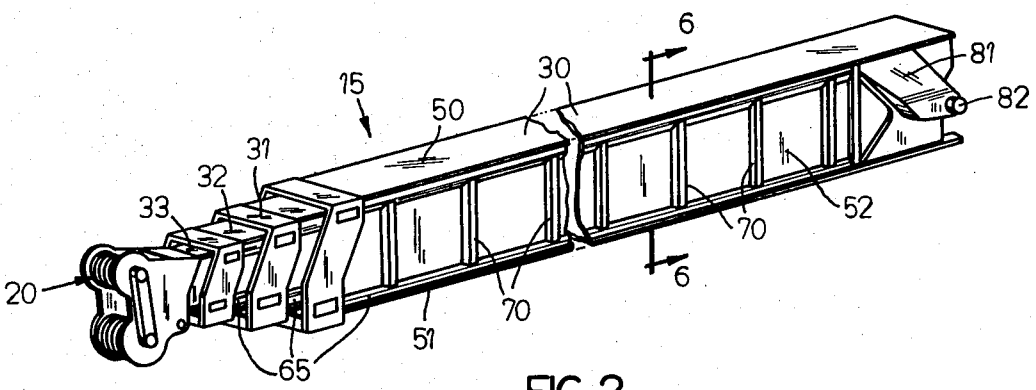
FIG. 2 is an enlarged perspective view of the telescopic boom of FIG. 1 and showing it as removed from the crane, lowered and fully retracted.
Figure 3:
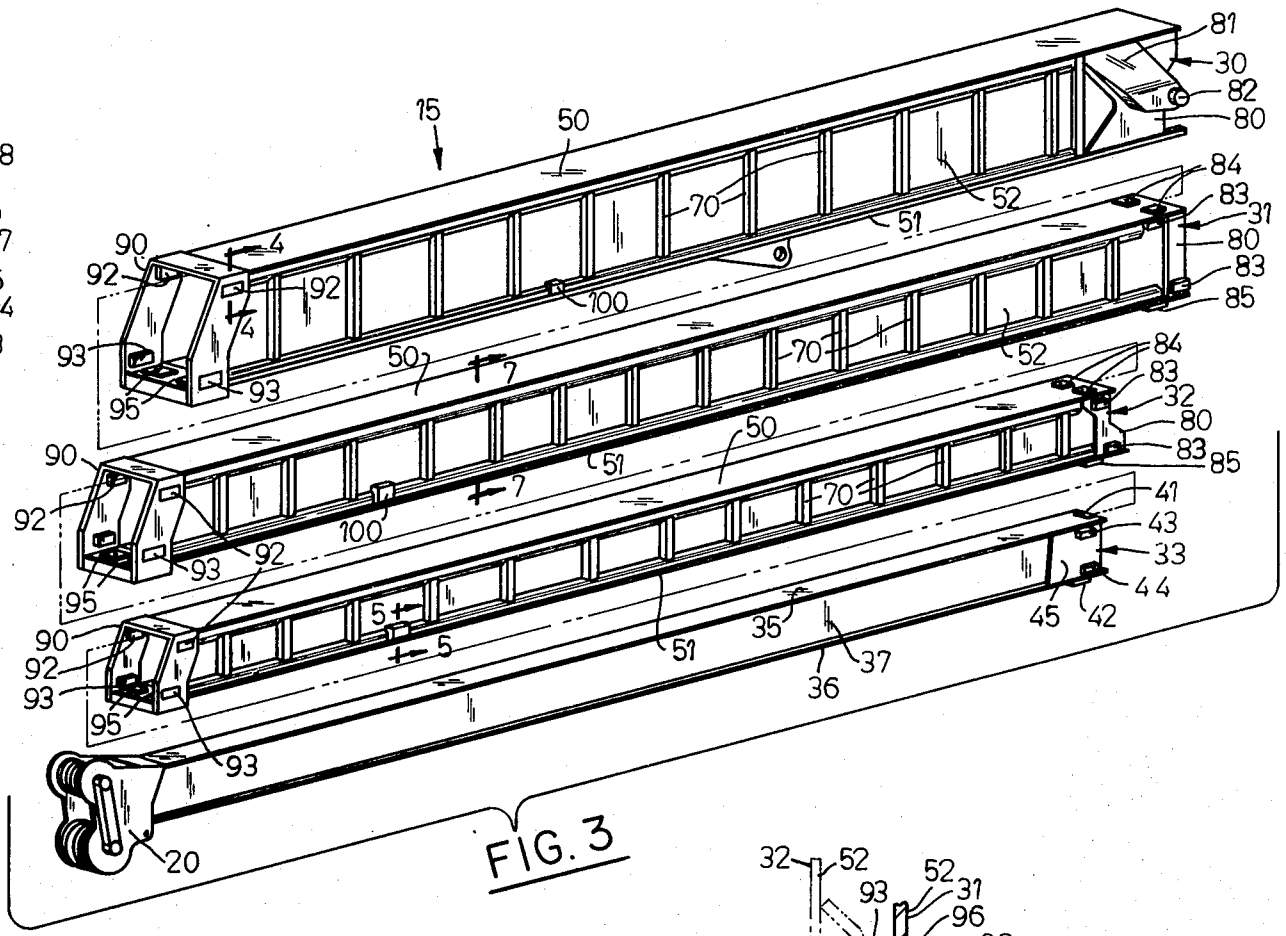
FIG. 3 is an exploded perspective view showing the boom sections of the telescopic boom of FIG. 2 fully separated from one another.
Figure 6:
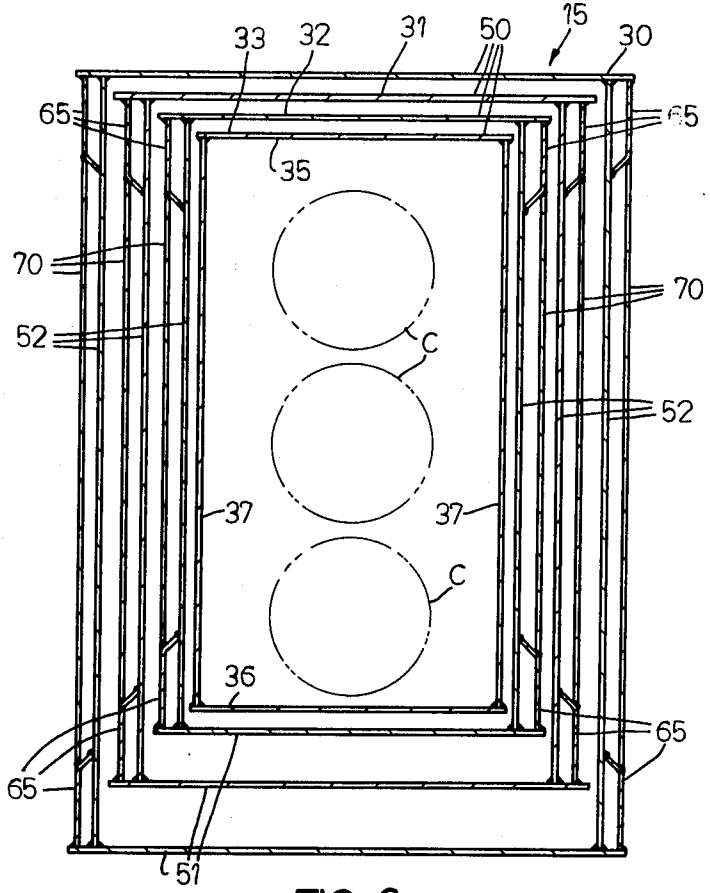
FIG. 6 is an enlarged cross-sectional view of the telescopic boom taken on line 6—6 of FIG. 2.
Figure 7:
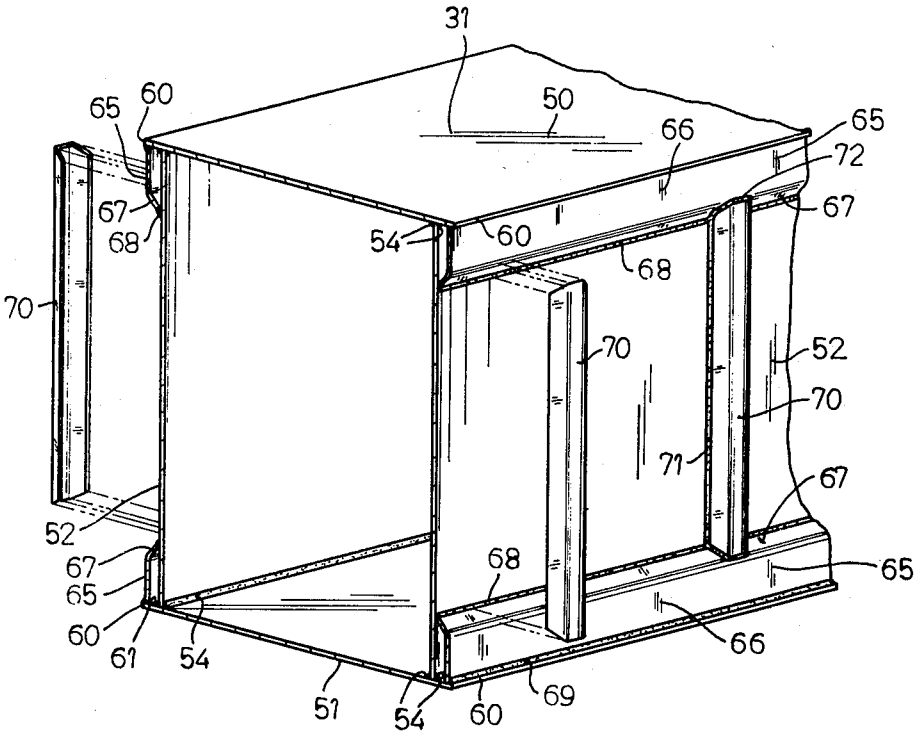
FIG. 7 is an enlarged perspective view of a boom section taken on line 7—7 of FIG. 3.

As FIGS. 1, 2, and 3 show, boom 15 comprises a plurality of boom sections of hollow rectangular cross-section, namely: a boom base section 30, an intermediate section 31, an outer section 32, and a fly section 33, each of progressively smaller transverse cross-section so that they are telescopable, one within another. Boom sections 30, 31, and 32 are constructed in accordance with the invention and are generally similar to each other except for size, whereas fly section 33 is conventional. FIG. 1 shows boom 15 fully extended and FIG. 2 shows it fully retracted, whereas FIG. 3 shows the boom sections 30, 31, 32, and 33 separated from one another so that they can be compared. FIG. 6 shows boom extension cylinders C.

Figure 8:
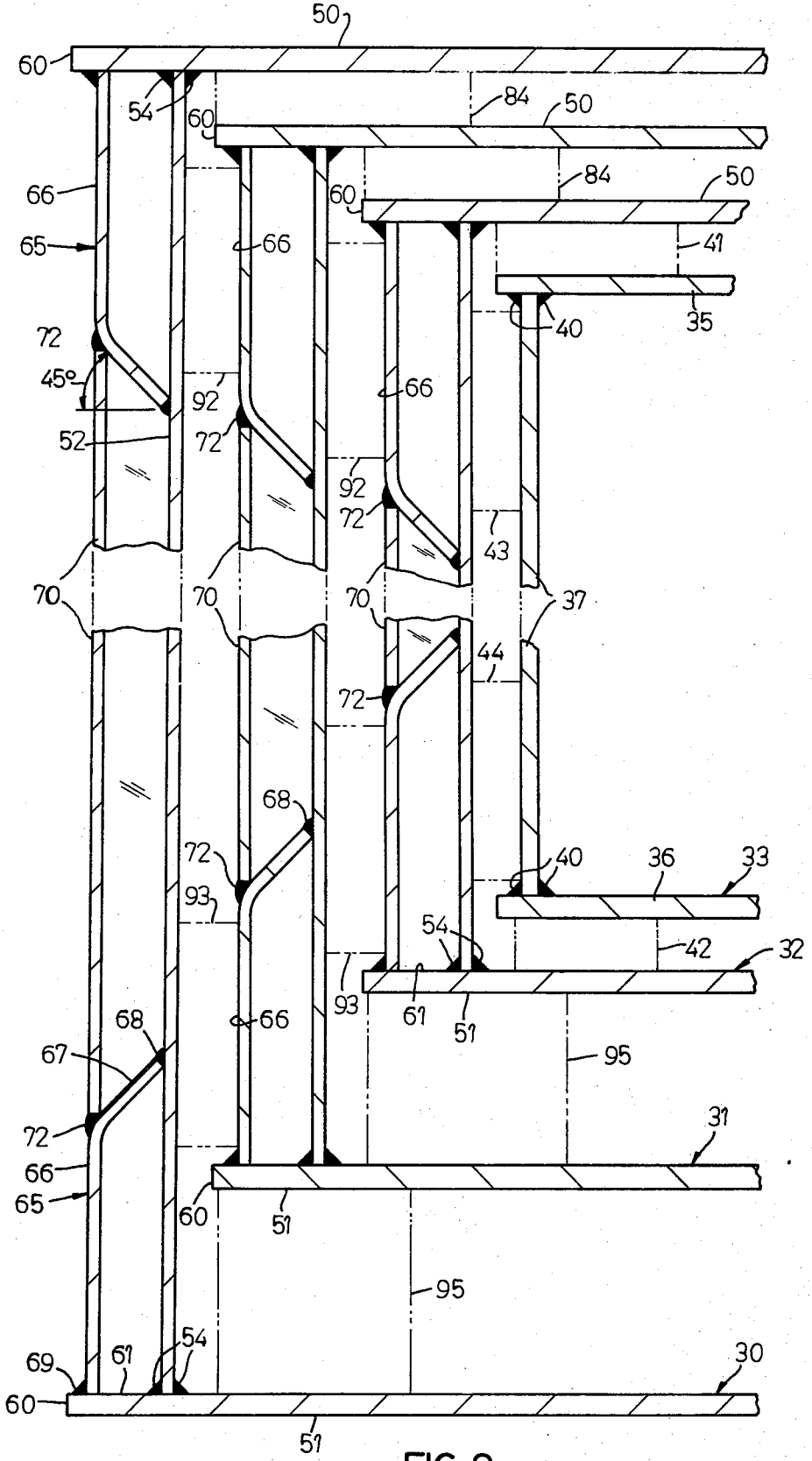
FIG. 8 is a greatly enlarged cross-sectional view also taken on line 6—6 of FIG. 2 and showing portions of the telescopic boom in greater detail.

As FIGS. 3, 6, and 8 show, fly section 33 comprises solid flat top and bottom plates 35 and 36, respectively, and a pair of spaced apart solid flat side plates 37 edge-welded therebetween as at 40 (see FIG. 8). Fly section 33 includes the hoist line sheave assembly 20 at its outer end and is provided at its inner end with a top slide pad 41 attached to its top plate 35, a bottom slide pad 42 on its bottom plate 36, and with upper and lower side slide pads 43 and 44, respectively, on support plates 45 which are secured to the side plates 37.

FIGS. 3, 6, 7, and 8 show the plurality of (three) large light-weight deflection-resistant telescopic boom sections 30, 31, and 32 constructed in accordance with the present invention. In the following description, similar components are designated by the same numbers. Each boom section 30, 31 and 32 is of hollow rectangular cross-section and comprises spaced apart top and bottom plates 50 and 51, respectively, between which a pair of spaced apart vertical side plates 52 are welded as at 54. Each side plate 52 is located inwardly of the associated edges 60 of the top and bottom plates 50 and 51 so that portions 61 of the top and bottom plates 50 and 51 extend outwardly therebeyond, as FIGS. 7 and 8 best show.

Four longitudinal corner stiffeners 65 of angular cross-section are provided for each boom section 30, 31, and 32, one at each corner thereof, to shorten the effective height of the side plates 52 and stiffen the top and bottom plates 50 and 51, respectively. Each longitudinal corner stiffener 65 comprises a flat side portion 66 and an inwardly bent portion 67, such flat side portion 66 being spaced from and parallel to an associated side plate 52 and also serving as a slide pad bearing surface for the slide pads. Each longitudinal corner stiffener 65 extends between and is welded as at 68 to a side plate 52 and as at 69 to the outwardly extending edge portion 61 of either the top plate 50 or bottom plate 51. Each corner stiffener 65 is welded to a side plate along a line which is spaced from the edge of the side plate by about 1/10 to 2/10 of the height of the side plate.

A plurality of vertical side stiffeners 70 of generally U-shaped or trapezoidal-shaped cross-section are disposed in longitudinally spaced apart arrangement along each side of each boom section 30, 31, and 32 to provide buckling resistance and increased shear load capacity for the side plates 52. Each vertical side stiffener 70 is welded as at 71 to a side plate 52 and as at 72 to the inwardly bent portion 67 of the top and bottom longitudinal corner stiffeners 65.

Figure 4:
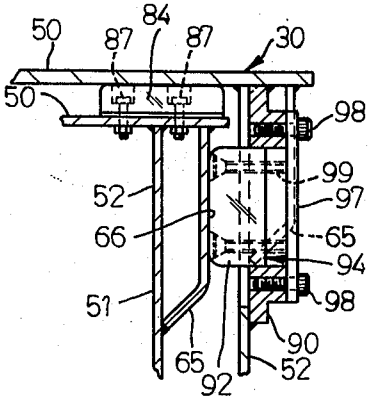
FIG. 4 is an enlarged cross-sectional view taken on line 4—4 of FIG. 3 and showing upper slide pads between two adjacent boom sections.

Each boom section 30, 31, and 32 is provided at its inner end with a support plate bracket or structure 80 on opposite sides thereof. The structures 80 on boom section 30 each have a trunnion support 81 secured thereto for supporting a trunnion 82 by means of which boom section 30 is pivotally mounted on crane upper 14, as FIG. 1 shows. The structures 80 on boom sections 31 and 32 have outwardly extending slide pads 83 mounted thereon. Boom sections 31 and 32 also have outwardly extending top slide pads 84 and bottom slide pads 85 mounted at the inner ends of the top and bottom plates 50 and 51, respectively, by means of nut and bolt assemblies 87, as FIG. 4 shows. The bottom slide pads 85 are understood to be similarly mounted.

Each boom section 30, 31, and 32 is provided at its outer end with a support structure 90 which has inwardly extending upper and lower side slide pads 92 and 93, respectively, mounted thereon by means of slide pad support assembly 94, such as shown in FIG. 4. Inwardly extending similarly supported bottom slide pads 95 are also provided. Slide pad support 94, attached to structure 90, by the screws 98, and carries the slide pad 92 which, for example, is secured to plate member 97 by screws 99. Slide pad 92 and plate member 97 are free to float in the pocket of the structure composed of 90, 94, and 98.

Figure 5:
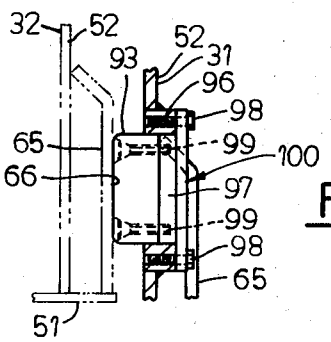
FIG. 5 is an enlarged cross-sectional view taken on line 5—5 of FIG. 3 and showing a lower slide pad between two adjacent boom sections.

Each boom section 30, 31, and 32 is also provided with a side-mounted slide pad assembly 100 on each side thereof intermediate its ends. Slide pad assembly 100, shown in FIG. 5, is similar to that shown in FIG. 4 but is at a different location on the boom section. As FIG. 5 shows, assembly 100 comprises a bracket 96 welded to a side 52 and a plate member 97, which carries the slide pad 93, is secured to bracket 96 by screws 98. Pad 93 is secured to plate member 97 by screws 99 and is free to float in the pocket composed of 96, 94 and 98.

As FIG. 8 best shows, the top slide pads 41 and 84 slide against the underside of the adjacent top plate 50. The bottom slide pads 95 slide against the underside of the adjacent bottom plate 51. The slide pads 92 and 93 each slide against the flat outer side portion 66 of an associated longitudinal corner stiffener 65 on the adjacent inner boom section. The slide pads 43, 44, and 83 slide against the flat inner side of the vertical side plate 52 of the adjacent outer boom section.

Each side plate is about $\frac{2}{3}$ to $\frac{3}{4}$ as wide as an associated top or bottom plate, for example.

We claim:

1. In a hollow rectangular boom section for a telescopic crane boom:

a pair of spaced apart first plates including a top plate and a bottom plate, each top plate and bottom plate having side edges;

a pair of spaced side plates connected between and inwardly of said side edges of said first plates whereby outwardly projecting edge portions are defined on said first plates, each side plate being at right angles to said first plates;

a plurality of longitudinal corner stiffeners, one for each corner of said boom section, each longitudinal corner stiffener connected between a side plate and the outwardly projecting edge portion of one of said first plates inwardly of a side edge thereof to shorten the effective height of a side plate, each longitudinal corner stiffener including a slide pad bearing portion spaced from and parallel to its associated side plate;

and a plurality of side stiffeners in spaced apart relation along said side plates, each side stiffener connected to its associated side plate and to the longitudinal corner stiffeners therefor.

2. A boom section according to claim 1 wherein each longitudinal corner stiffener is of angular cross-sectional configuration.

3. A boom section according to claim 2 wherein each of said side stiffeners is of generally U-shaped configuration.

4. A boom section according to claim 1 wherein each longitudinal corner stiffener is connected to a side plate along a line which is spaced from the edge of the side plate by about 1/10 to 2/10 of the height of said side plate.

5. A boom section according to claim 4 wherein each side plate is wider than each of said pair of first plates.

6. A boom section according to claim 5 wherein each side plate is wider than each of said pair of first plates in a ratio between about $\frac{2}{3}$ and $\frac{3}{4}$.

7. In a hollow rectangular boom section for a telescopic crane boom:

a top plate having lateral edges;

a bottom plate having lateral edges;

a pair of spaced apart side plates disposed between and welded to said top plate and said bottom plate at locations inwardly of the lateral edges of said top plate and said bottom plate whereby said top plate and said bottom plates have outwardly projecting edge portions, each side plate being at right angles to said top plate and said bottom plate;

a plurality of longitudinal corner stiffeners, one for each corner of said boom section, each longitudinal corner stiffener having an angular cross-section and including a flat side portion and an inwardly extending portion, each longitudinal corner stiffener being welded to a side plate and to an outwardly projecting edge portion of one of said top plates or bottom plates inwardly of a lateral edge thereof so that said flat side portion is spaced from and parallel to an associated side plate;

and a plurality of vertical side stiffeners, each having a U-shaped cross-section, said vertical side stiffeners disposed in spaced apart relationship along said side plates, each vertical side stiffener being welded to a side plate and to the longitudinal corner stiffeners for the side plate.

8. A boom section according to claim 7 wherein each longitudinal corner stiffener is connected to a side plate along a line which is spaced from the edge of the side plate by about 1/10 to 2/10 of the height of said side plate.

9. A boom section according to claim 8 wherein each side plate is wider than each of said pair of first plates.

10. A boom section according to claim 9 wherein each side plate is wider than each of said pair of first plates in a ratio between about $\frac{3}{8}$ and $\frac{3}{4}$.

* * * * *